US011732700B2

(12) United States Patent
Argentino

(10) Patent No.: US 11,732,700 B2
(45) Date of Patent: Aug. 22, 2023

(54) AUTOMATIC BIDIRECTIONAL VALVE AND PUMP PROVIDED WITH SAID VALVE

(71) Applicant: ANNOVI REVERBERI S.P.A., Modena (IT)

(72) Inventor: Pierluigi Argentino, Castelfranco (IT)

(73) Assignee: ANNOVI REVERBERI S.P.A., Modena (IT)

( * ) Notice: Subject to any disclaimer, the term of this patent is extended or adjusted under 35 U.S.C. 154(b) by 264 days.

(21) Appl. No.: 17/083,392

(22) Filed: Oct. 29, 2020

(65) Prior Publication Data

US 2021/0131407 A1 May 6, 2021

(30) Foreign Application Priority Data

Oct. 30, 2019 (IT) ..... 102019000020072

(51) Int. Cl.
*F04B 1/0452* (2020.01)
*F04B 1/0408* (2020.01)

(52) U.S. Cl.
CPC ..... *F04B 1/0452* (2013.01); *F04B 1/0408* (2013.01); *F04B 2201/02* (2013.01); *F04B 2201/06* (2013.01)

(58) Field of Classification Search
CPC .. F04B 1/0452; F04B 1/0408; F04B 2201/02; F04B 2201/06; F04B 7/0208; F04B 53/102; F16K 15/1823; F16K 2200/303
See application file for complete search history.

(56) References Cited

U.S. PATENT DOCUMENTS

| | | | | |
|---|---|---|---|---|
| 4,551,077 | A | 11/1985 | Pacht | |
| 5,037,276 | A * | 8/1991 | Tremoulet, Jr. | F04B 53/103 417/470 |
| 5,362,216 | A * | 11/1994 | Hammelmann | F04B 53/007 417/571 |
| 2012/0251366 | A1* | 10/2012 | Kuroyanagi | F04B 53/1087 417/440 |
| 2013/0230423 | A1* | 9/2013 | Faneca Llesera | B05B 11/3047 92/248 |
| 2018/0298885 | A1* | 10/2018 | Gilpatrick | F04B 1/143 |
| 2019/0120392 | A1* | 4/2019 | Lee | B60T 8/341 |

FOREIGN PATENT DOCUMENTS

| | | | |
|---|---|---|---|
| DE | 697008 | C | 10/1940 |
| DE | 1162855 | B | 2/1964 |
| EP | 1998045 | A1 | 12/2008 |

* cited by examiner

*Primary Examiner* — Connor J Tremarche
(74) *Attorney, Agent, or Firm* — Volpe Koenig

(57) ABSTRACT

An automatic bidirectional valve includes: a valve body, a central conduit that crosses the valve body and is provided with a first opening in a first end of the valve body and a second opening made in an opposite second end thereof, and a peripheral conduit made in the valve body, provided with a first opening, made in a portion of the valve body between the first and second ends, and a second opening made in the second end. A first shutter is movable between a closing position and an opening position, a first elastic element configured to generate a force adapted to maintain the first shutter in the closing position, a second shutter movable between a closing position, and an opening position, a second elastic element configured to generate a force to maintain the second shutter in the closing position, and a retaining body fixed to the valve body.

11 Claims, 8 Drawing Sheets

AUTOMATIC BIDIRECTIONAL VALVE AND PUMP PROVIDED WITH SAID VALVE

CROSS REFERENCE TO RELATED APPLICATION(S)

This application claims the benefit of Italian Patent Application No. 102019000020072 filed on Oct. 30, 2019, which is incorporated by reference as if fully set forth.

TECHNICAL FIELD

The present invention relates to a valve, in particular an automatic bidirectional delivery and suction valve for pumps, for example at high pressure, and a pump provided with said valve, preferably an axial piston pump.

BACKGROUND

Automatic bidirectional valves are known, which, if connected to the pumping chamber of a pump, to a delivery conduit and to a suction conduit, automatically allow, on the basis of pressure differences, the suction of the liquid to be pumped through the suction conduit towards the pumping chamber and sending the pumped fluid from the pumping chamber to the delivery conduit.

A known embodiment of said automatic bidirectional valves comprises a valve body in which a central conduit is made which crosses it from side to side, defining a first opening at a first axial end and a second opening at a second axial end of the valve body. Said central conduit is configured to place the pumping chamber in fluid communication with the delivery conduit.

The valve then comprises a peripheral conduit eccentric with respect to the central conduit and provided with a first opening, made in a lateral surface of the valve body, and a second opening made in the second end of the valve body. The peripheral conduit is configured to place the suction conduit in fluid communication with the pumping chamber.

The valve also comprises a first shutter, to hermetically close the first opening of the central conduit under the thrust of a first elastic element, and a second shut-ter to hermetically close the second opening of the peripheral conduit under the thrust of a second elastic element.

In particular, the valve is shaped in such a way that when the volume of the pumping chamber increases, a depression is generated in it which overcomes the force of the second elastic element, freeing the second opening of the peripheral conduit from the second shutter. Whereas, when the volume of the pumping chamber decreases, an overpressure is generated in the pumping chamber itself which overcomes the force of the first elastic element, freeing the first opening of the central conduit from the first shutter.

A drawback of the prior art is that in order to maintain in position the elastic elements it is necessary to make suitable seats and/or insert suitable shoulder rings in the pump head in which the pumping chamber is contained, which involves complications from the point of view of design of the pump head and from the point of view of the valve and/or pump assembly.

The object of the present invention is to overcome the constraints of the prior art in the context of a simple and rational constructive solution.

Such object is achieved by the features of the invention indicated in the independent claim. The dependent claims outline preferred and/or particularly advantageous aspects of the invention.

SUMMARY

The invention, particularly, makes available an automatic bidirectional valve for high pressure pumps comprising:

a valve body, a central conduit of the through type that crosses the valve body and is provided with a first opening made in a first end of the valve body and a second opening made in an opposite second end of the valve body, a peripheral conduit made in the valve body, eccentric with respect to the central conduit and provided with a first opening, made in a portion of the valve body comprised between the first end and the second end, and a second opening made in the second end of the valve body, a first shutter movable at least between a closing position, in which it hermetically obstructs the first opening of the central conduit, and an opening position, in which it is distanced from the first opening of the central conduit and allows the passage of flow through the first opening itself, a first elastic element configured to generate a force adapted to maintain the first shutter in the closing position, a second shutter movable at least between a closing position, in which it hermetically obstructs the second opening of the peripheral conduit, and an opening position, in which it is distanced from the second opening of the peripheral conduit and allows the passage of flow through the second opening itself, a second elastic element configured to generate a force adapted to maintain the second shutter in the closing position, and a retaining body fixed to the valve body and configured to hold in position one from among the first elastic element and the second elastic element so that said elastic element exercises said force on the respective shutter.

Thanks to this solution, it is not necessary to perform machining to create shoulders adapted to maintain the elastic element in position with respect to the valve body in the pump heads in which the valve must be housed, which allows to re-duce design times, production times and costs. Furthermore, the fact that the retaining body is fixed with respect to the valve body simplifies and speeds up the assembly operations of the pump.

According to an aspect of the invention, the retaining body can be removably fixed to the valve body.

This feature makes it possible to simplify the valve maintenance operations, for example to allow the elastic elements to be replaced.

For example, the retaining body can be fixed to the valve body by means of a snap coupling mechanism.

In this way the assembly and disassembly of the valve are particularly practical and quick, and do not require the use of tools.

According to another aspect of the invention, the retaining body can be configured to hold in position the second elastic element.

Generally, as illustrated in this document, the second end is the one turned towards the pumping chamber and in this way there is no need for shoulders in the cylinder or in the cylinder jacket, if a jacket is provided, to hold the retaining body in place.

According to a further aspect of the invention, the valve can comprise two retaining bodies, of which a first retaining body fixed to the valve body and configured to hold in position the first elastic element and a second retaining body fixed to the valve body and configured to hold in position the second elastic body.

Another aspect of the invention provides that the second retaining body can comprise a cup-shaped portion provided with a through hole at least partially aligned with the central hole of the valve body and a through opening eccentric with respect to the through hole and adapted to be closed by the second shutter when a flow at the outlet from the peripheral conduit overcomes the force of the second elastic element.

In this way, when the pressure in the pumping chamber of the pump in which the valve is installed increases, a faster closing of the second shutter is guaranteed. Furthermore, this feature allows a faster opening of the second shutter since it allows the fluid present inside the retaining body to be expelled more quickly. These are the advantages compared to when there is only the through hole of the retaining body.

Another aspect of the invention provides that the valve body can be monolithic and made of a single material.

In this way the valve is particularly resistant and durable.

Furthermore, the only material of which the valve body is made can be a metal material chosen from the following group of metal materials from stainless steel, brass alloys and aluminum alloys.

In particular, aluminum should then undergo a surface hardening treatment.

These characteristics contribute to improving the resistance and increasing the life of the valve.

The invention also makes available an axial piston pump for pumping a liquid comprising:

a base a head fixed to said base a plurality of cylinders having central axes parallel to each other and obtained in the head a plurality of pistons that each slide within a respective cylinder of the plurality of cylinders for the pumping of the liquid, an inclined piston configured to activate the sliding of said pistons within the respective cylinders, and a valve, according to at least one of the aspects of the invention described above, for each cylinder.

Thanks to this solution, a faster design pump is made available with respect to prior art devices and whose assembly is quicker.

According to an aspect of the invention, each cylinder can be made in the head like a blind hole, and each valve can be housed in a bottom portion of the respective cylinder, which bottom portion is shaped so that the valve is oriented with central axis of the central conduit parallel to a central axis of the cylinder and occludes said bottom portion Thanks to this solution, the head is more resistant to fatiguing loads due to pressure pulsations and therefore can be made of materials with lower resistance to fatiguing loads, such as aluminum, compared to those currently used that are stainless steel and brass. Aluminum has the advantage of being better machinable and lighter than stainless steel and brass alloys. The advantage is given in particular because this configuration allows to reduce the number of holes that cross the head to insert the valves compared to the pumps of the prior art, and therefore to reduce the geometries of the head which cause notching effects, which in turn cause the decrease in the fatigue resistance of the head. In particular, in known axial piston pumps provided with inclined piston, a one-way automatic suction valve and a one-way automatic delivery valve are used for each cylinder, and for the installation of at least one of the two it is necessary to make a hole in one face of the head opposite to the base. The configuration of the pump according to the invention allows not to have to make these holes in these positions, thus improving the fatigue resistance of the head.

Furthermore, the valve substantially acts as a screen to the bottom wall for the fatiguing pressure variations occurring in the pumping chamber.

Furthermore, this configuration allows to make all the connection components of the pump, for suction and delivery, on one side only.

Another aspect of the invention contributes to perfecting these improvements in resistance to fatiguing forces, according to which each cylinder comprises a jacket inserted in the cylinder itself and inside which the respective piston slides, which jacket extends from the automatic bidirectional valve to at least a first annular sealing gasket which encircles the piston.

In this way it is possible to further reduce the fatiguing stresses to which the head is subjected since the valve and the jacket substantially isolate the head from such pulsations.

According to another aspect of the invention, the head is made of die-cast aluminum.

In this way it is light and easy to machine.

BRIEF DESCRIPTION OF THE DRAWINGS

Further features and advantages of the invention will be more apparent after reading the following description provided by way of non-limiting example, with the aid of the figures illustrated in the accompanying drawings.

DETAILED DESCRIPTION OF THE PREFERRED EMBODIMENTS

Figure 1:
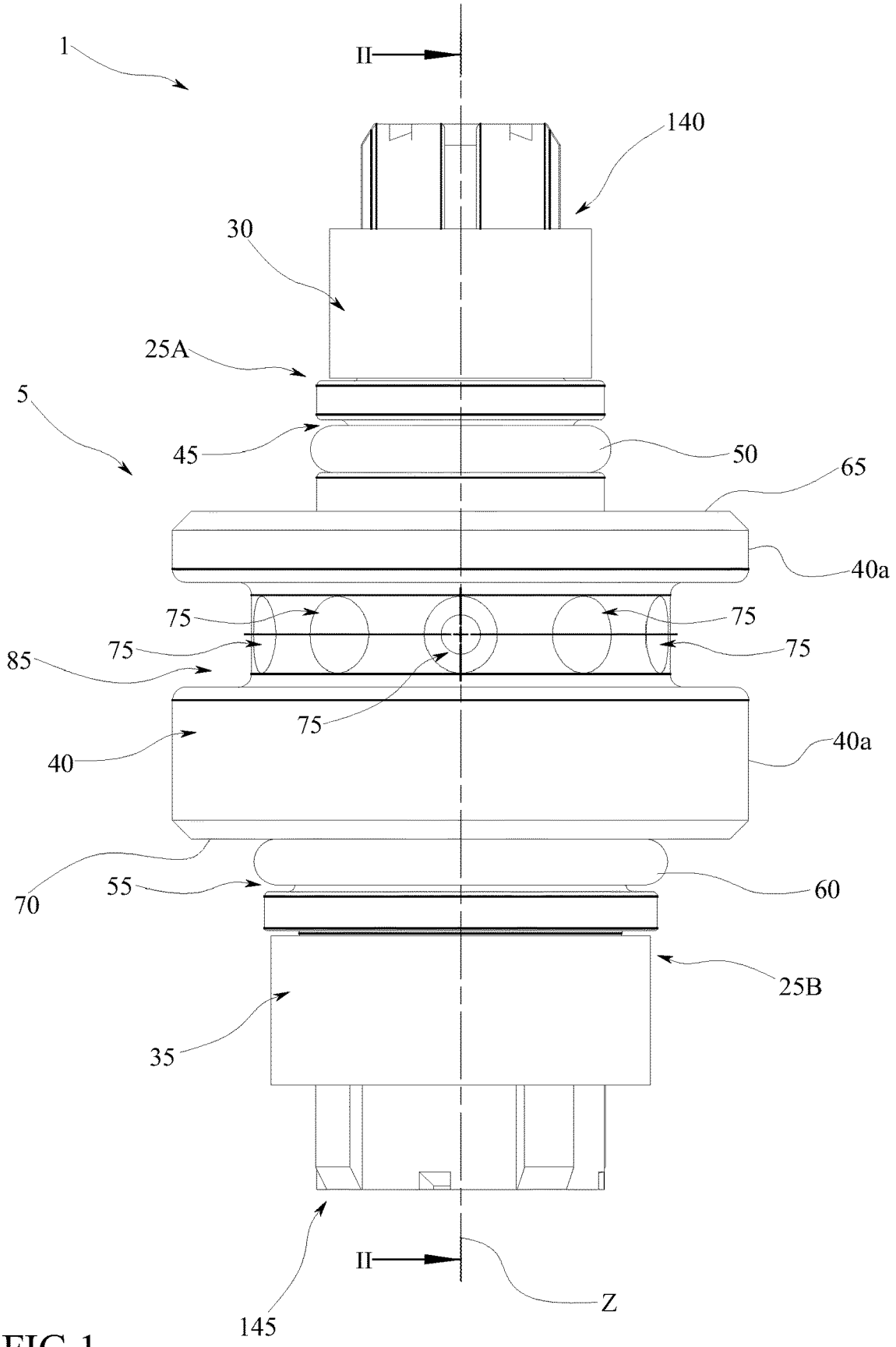
FIG. 1 is a front view of an automatic bidirectional valve according to the invention.
Figure 2:
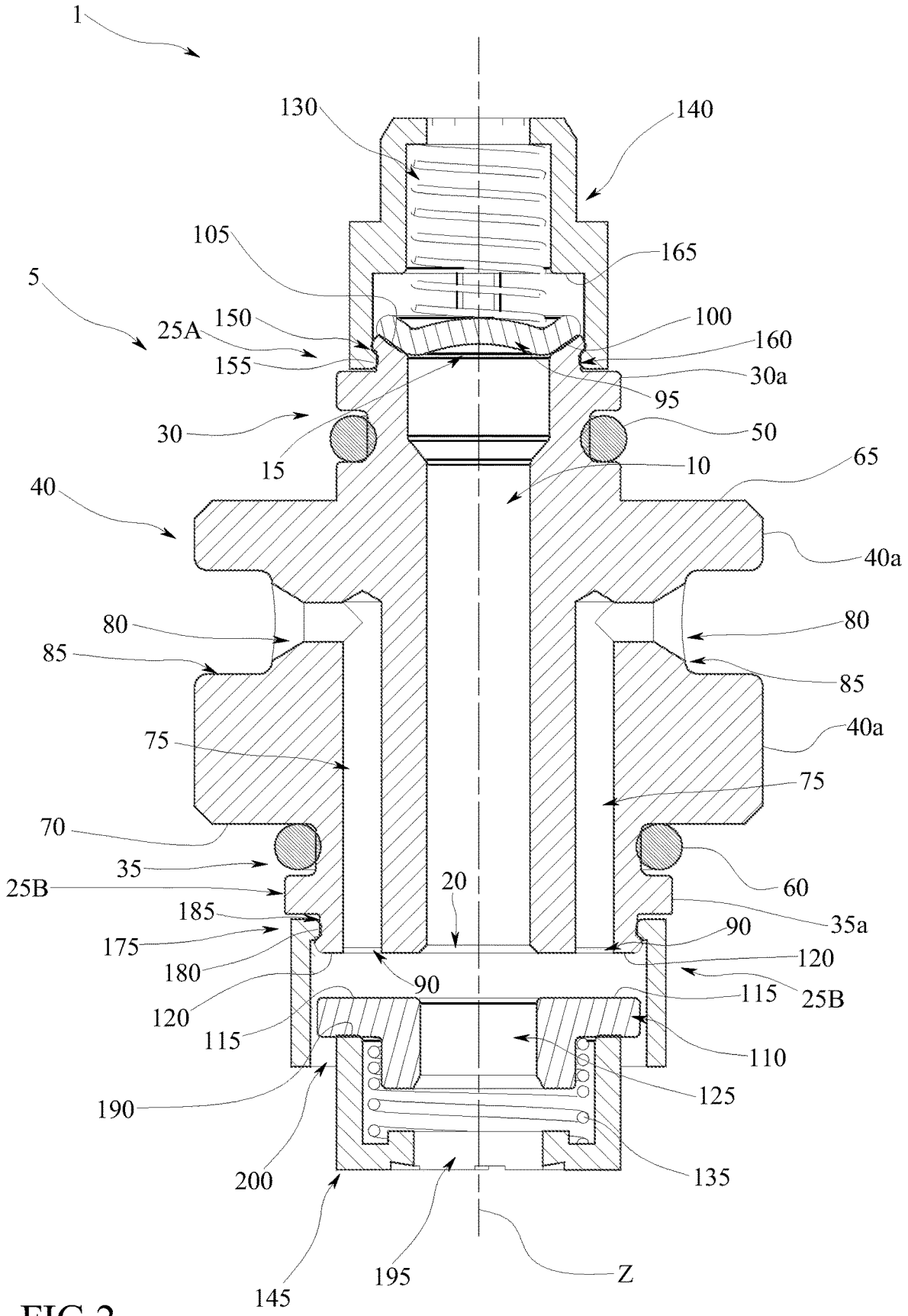
FIG. 2 is a sectional view along the plane II-II of the valve in FIG. 1 illustrated in a suction phase.
Figure 3:
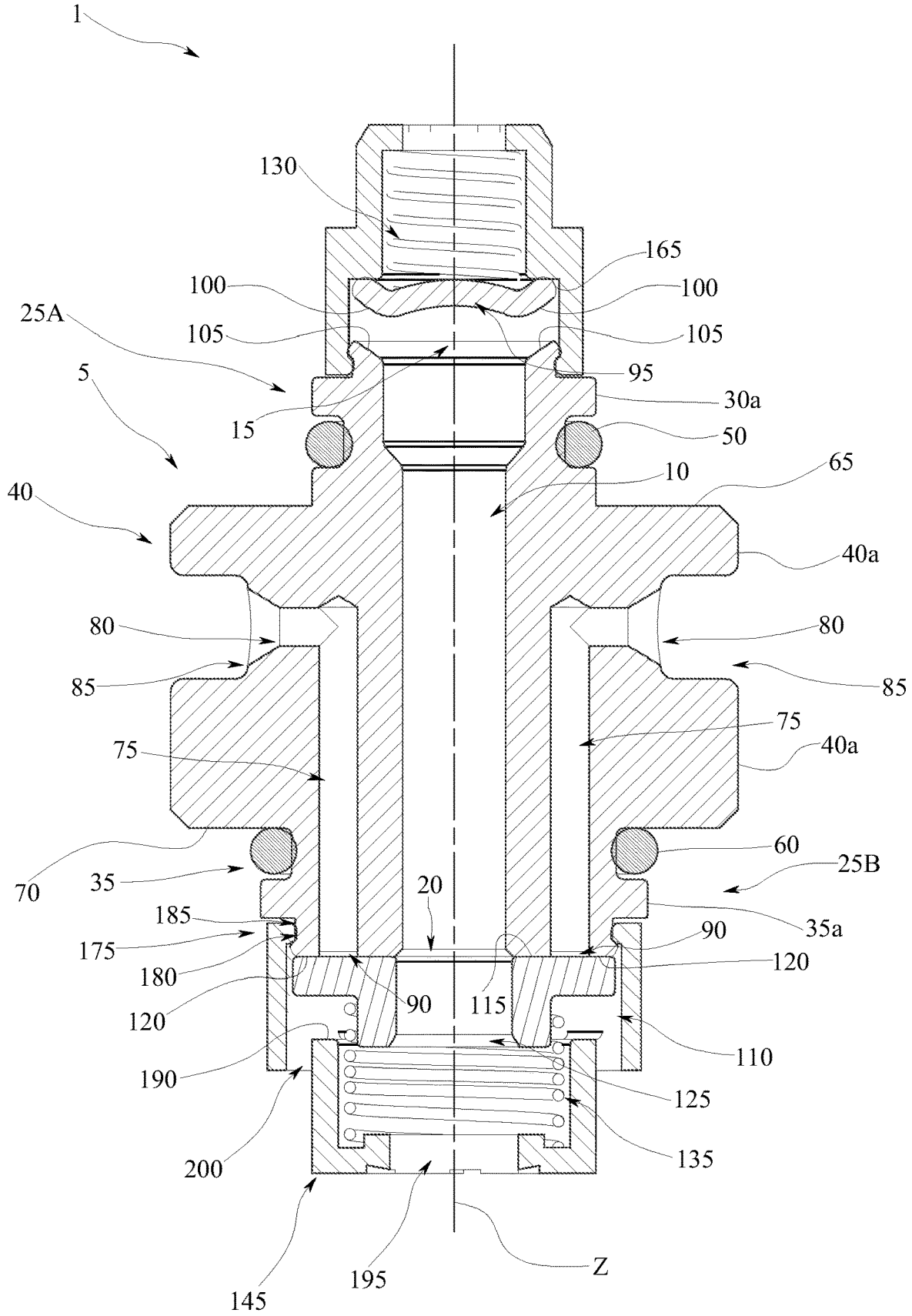
FIG. 3 is a sectional view along the plane II-II of the valve in FIG. 1 illustrated in a delivery phase.

With particular reference to FIGS. 1 to 3, 1 generally indicates an automatic bi-directional valve, hereinafter abbreviated as valve 1.

It should be noted that an automatic valve means a valve configured to open automatically, allowing a fluid communication between two or more environments, between which it is interposed, upon reaching a preset difference between the pressures present in the environments divided by the valve itself. Even more in detail, automatic valves do not exploit electromechanical actuation mechanisms, but only the pressure differences.

It is also specified that bidirectional valve means a valve adapted to be inter-posed between a first environment, a second environment and a third environment and configured to selectively put in communication either only the first environment with the second environment or only the second environment with the third environment. When the valve is installed in a pump, the first environment is a suction conduit, the second environment is a pumping chamber and the third environment is a delivery conduit.

A first embodiment of the valve 1 is described below, illustrated in FIGS. 1 to 6.

The valve 1 comprises a valve body 5 which is crossed from side to side by a central conduit 10 provided with a first opening 15 and an opposite second opening 20 made in the valve body itself. That is, said central conduit 10 comprises a first opening 15 made in a first end 25A of the valve body 5 and a second opening 20 made in an opposite second end 25B of the valve body 5. In particular, the central conduit 10 comprises only the first opening 15 and the second opening 20.

These ends are axial ends of the valve body 5 with respect to a central axis Z of the valve body itself, with respect to which the central conduit 10 is coaxial. In particular, the valve body 5 is shaped like a body of revolution with respect to said central axis Z.

Furthermore, the valve body 5 can comprise a first portion 30, at which the first opening 15 is made, a second portion 35, at which the second opening 20 is made, and a third portion 40, which is interposed, for example directly and in contact, between the first portion and the second portion and is crossed by the central conduit 10.

The first portion 30 is cylindrical in shape, coaxial to the central axis Z, in particular it has a cylindrical lateral surface 30*a*. For example, the first portion comprises a seat 45, shaped as an annular recess made at the cylindrical lateral surface of the first portion itself, adapted to accommodate a sealing gasket 50.

The second portion 35 is also cylindrical in shape, coaxial to the central axis Z, in particular it has a cylindrical lateral surface 35*a*. For example, the second portion 35 comprises a seat 55, shaped as an annular recess made at the cylindrical lateral surface of the second portion itself, adapted to accommodate a sealing gasket 60.

The third portion 40 is cylindrical in shape and has a greater radius than the first portion and the second portion, so as to protrude with respect thereto in a radial direction with respect to the central axis Z. In particular, the third portion has a cylindrical lateral surface 40*a* which protrudes radially with respect to the cylindrical lateral surfaces 30*a*, 35*a* of the first portion and of the second portion.

The valve body 5 comprises a first abutment surface 65 and an opposite second abutment surface 70, transversal to the central axis Z. In particular, these abutment surfaces 65,70 are flat, for example annular, preferably lying on planes perpendicular to the central axis Z.

The first abutment surface 65 and the second abutment surface 70 can be made in the third portion 40 of the valve body 5. In practice, said abutment surfaces 65,70 protrude radially in a cantilever manner with respect to the first portion 30 and to the second portion 35, that is, with respect to the cylindrical lateral surface 30*a* of the first portion and to the cylindrical lateral surface 35*a* of the second portion, in the opposite direction with respect to the central conduit 10. Purely by way of example, the first abutment surface 65 is turned towards the first portion 30, while the second abutment surface 70 is turned towards the second portion 35. In this case the first abutment surface 65 extends from the cylindrical lateral surface 40*a* of the third portion 40 to the cylindrical lateral surface 30*a* of the first portion and the second abutment surface 70 extends from the cylindrical lateral surface 40*a* of the third portion 40 to the cylindrical lateral surface of the second portion 35.

The first abutment surface 65 and the second abutment surface 70 are adapted to allow the correct positioning and locking of the valve body 5 when it is insert-ed in a respective seat made in a pump.

The central conduit 10 which crosses the valve body, that is which crosses in sequence the first portion 30, the third portion 40 and the second portion 35, is rectilinear, and is preferably provided with an internal cylindrical surface.

The valve body 5 is made as a single monolithic body of a single metal material, that is, it can be obtained by machining a single body obtained by solidifying a single cast or injection of material into a mold.

Such metal material is chosen from the following group of metal materials comprising stainless steel, brass alloys and aluminum alloys.

In the case of aluminum, it must then be hardened on the surface.

The valve 1 comprises a peripheral conduit 75 made in the valve body, for ex-ample in the second portion 35 and in the third portion 40, eccentric and distinct from the central conduit 10.

Said peripheral conduit 75 comprises a first opening 80 made in a portion, for example in a lateral surface, of the valve body 5 comprised between the first end 25A and the second end 25B. For example, the first opening is made in the cylindrical lateral surface 40*a* of the third portion 40. In detail, the first opening 80 opens into an annular groove 85 made in the third portion and open on the cylindrical lateral surface 40*a* of the third portion itself.

The peripheral conduit 75 also comprises a second opening 90, in particular the peripheral conduit comprises only said first opening 80 and second opening 90.

The second opening 90 is made in the second end of the valve body 5 and is distinct from the second opening 20 of the central conduit 10. Preferably the second opening 20 of the central conduit and the second opening 90 of the peripheral conduit 75 lie on the same plane, for example perpendicular to the central axis Z. That is, the second end of the valve body comprises a flat surface, for example perpendicular to the central axis Z, in which the second opening 90 of the peripheral conduit 75 is made.

For example, the peripheral conduit 75 comprises at least a rectilinear segment which ends in the second opening 90 and which has a longitudinal axis parallel to the central axis Z.

Preferably, the valve comprises a plurality of peripheral conduits 75, each shaped as described above, arranged circumferentially with respect to the central conduit 10, that is to the central axis Z.

The valve 1 comprises a first shutter 95, which is movable at least between a closing position, in which it hermetically obstructs the first opening 15 of the central conduit 10, and an opening position, in which it is distanced from the first opening 15 of the central conduit and allows the passage of flow through the first opening itself.

In particular, the first shutter comprises a contact surface 100 which, when the first shutter is in the closing position, is in contact, at least along a closed perimeter, with a seat 105 of the first shutter made in the valve body 5 at the first opening 15. For example, the first shutter 95 is provided with a truncated-conical con-tact surface 100 and the seat 105 is provided with a matching truncated-conical contact surface.

The valve 1 also comprises a second shutter 110, which is movable at least between a closing position, in which it hermetically obstructs the second opening 90 of the peripheral conduit 75, and an opening position, in which it is distanced from the second opening 90 of the conduit peripheral 75 and allows the passage of flow through the second opening itself.

In particular, the second shutter 110 comprises a contact surface 115, which, when the second shutter is in the closing position, is in contact, at least along a closed perimeter, with a seat 120 of the second shutter made in the valve body. 5 at the second opening 90. For example, the contact surface 115 is flat and the seat 120 is provided with a matching flat contact surface. In particular, the flat contact surface of the second shutter is annular and is shaped so as to come into contact with a flat surface into which the second openings 90 of the plurality of peripheral conduits 75 open.

Said second shutter 110 comprises a through hole 125 which is always in direct fluid communication with the central conduit through the second opening 20. In particular, the through hole 125 crosses the contact surface 115 of the second shutter itself.

For example, said through hole 125 is coaxial to the central axis Z and internal with respect to the flat contact surface 115 of the second shutter 110.

Furthermore, said through hole 125 can have a diameter greater than a diameter of the second opening 20 of the central conduit 10.

The valve 1 comprises a first elastic element 130 configured to generate a force adapted to maintain the first shutter 95 in the closing position and a second elastic element 135 configured to generate a force adapted to maintain the second shutter 110 in the closing position. These elastic elements are preferably springs, for example helical compression ones.

Furthermore, the valve 1 comprises a retaining body 140,145 fixed, for example rigidly, i.e. without residual degrees of freedom, to the valve body 5 and configured to hold in position one from among the first elastic element and the second elastic element with respect to the valve body 5, so that said elastic element generates said force adapted to maintain the respective shutter in the closing position.

In particular, the retaining body 140,145 is removably fixed to the valve body 5, i.e. the retaining body 140,145 is fixed to the valve body by means of a connection member which allows both the fixing of the retaining body 140,145 to the valve body, and the removal of the retaining body 140,145 from the valve body.

In particular, the retaining body 140,145 is fixed to the valve body by means of a snap coupling mechanism, that is, said connection member comprises a snap coupling mechanism.

Said snap coupling mechanism is of the type in which at least one from among the valve body and the retaining body 140,145 deforms elastically against the other during a mutual approach of said bodies, so that during said approach a protuberance of a body slides on a contact surface of the other body until it is inserted into a cavity of said other body, where it is then maintained thanks to the elastic deformation generated during the relative sliding. The cavity is shaped in such a way as to prevent, by obstacle, a movement of the retaining body 140,145 along a direction parallel to the central axis Z. For example, it is the retaining body 140,145 which elastically deforms with respect to the valve body.

In particular, the retaining body 140,145 can comprise at least an end portion provided with a protuberance and a flexibly-deformable wall, from which the protuberance projects towards the center of the retaining body 140,145 itself, and the valve body comprises a cavity, for example an annular groove, adapted to accommodate the retaining body 140,145 and shaped so as to prevent, by obstacle, a movement of the retaining body 140,145 along a direction parallel to the central axis Z.

The retaining body 140,145 has a portion shaped like a cup-shaped body inside which the respective shutter is contained.

For example, the retaining body 140,145 comprises an abutment surface for the shutter, distanced from the valve body 5, preferably perpendicular to the central axis Z, which defines an end stop for moving the shutter away from the valve body. In particular, it defines a position of maximum opening of the shutter itself, in which the distance of the shutter from the respective opening that is configured to close is maximum.

The abutment surface contacts a surface of the respective shutter opposite to the contact surface of the corresponding shutter.

It is not excluded that in an alternative embodiment the retaining body 140,145 is fixed to the valve body by means of other removable connecting means such as for example threaded connection members or threaded portions obtained on the retaining body 140,145 and on the valve body themselves.

Furthermore, the retaining body comprises a surface adapted to act as a guide for the respective shutter, so as to prevent a rotation of the shutter with respect to an axis of rotation perpendicular to the direction along which the shutter itself moves.

The valve can comprise a first retaining body 140 and a second retaining body 145.

The first retaining body 140 is fixed, for example rigidly, i.e. without residual degrees of freedom, to the valve body 5, in particular to the first portion 30, and is configured to hold in position the first elastic element 130 with respect to the valve body 5, so that the first elastic element 130 generates the force adapted to maintain the first shutter 95 in the closing position.

The first retaining body 140 can be removably fixed to the valve body, i.e. by means of a connection member which allows both the fixing of the first retaining body 140 to the valve body 5 and the removal of the first retaining body from the valve body 5.

For example, the first retaining body 140 is fixed to the valve body by means of a snap coupling mechanism 150, i.e. said connection member comprises a snap coupling mechanism.

In particular, the first retaining body 140 comprises a cup-shaped portion and arranged with a concavity turned towards the valve body 5, i.e. towards the first portion 30 of the valve body, and the snap coupling mechanism 150 comprises a flexibly-deformable end portion obtained at the end of the cup-shaped body turned towards the valve body, which end portion is provided with a protuberance 155, for example annular and concentric to the central conduit 10, which projects towards an internal volume of the cup-shaped portion. The snap coupling mechanism of the first retaining body 140 also comprises a cavity, for example an annular groove 160, obtained in the valve body, that is in the first portion of the valve body, and adapted to accommodate the protuberance of the first retaining body. Said cavity is shaped in such a way as to make a connection by obstacle with said protuberance.

The first retaining body may comprise an abutment surface 165 for the first shut-ter 95, which abutment surface is distanced from the valve body 5, is preferably perpendicular to the central axis Z, and defines an end stop when the first shutter 95 moves away from the valve body.

Furthermore, the first retaining body can comprise a through hole 125 made at a bottom wall of the cup-shaped portion opposite to the portion of the first retaining body in contact with the valve body 5. This through hole 125 is crossed by the flow of fluid which crosses the first opening 15 of the central conduit 10.

The second retaining body 145 is fixed, for example rigidly, i.e. without residual degrees of freedom, to the valve body 5, in particular to the second portion 35, and is configured to hold in position the second elastic element 135 with respect to the valve body 5, so that the second elastic element 135 generates the force adapted to maintain the second shutter 110 in the closing position.

The second retaining body 145 can be removably fixed to the valve body 5, that is by means of a connection member which allows both the fixing of the second retaining body 145 to the valve body 5, and the removal of the second retaining body from the valve body, 5.

For example, the second retaining body 145 is fixed to the valve body by means of a snap coupling mechanism 175, that is said connection member comprises a snap coupling mechanism.

In particular, the second retaining body 145 comprises a cup-shaped portion and arranged with a concavity turned toward the valve body 5, i.e. the second portion 35, and the snap coupling mechanism 175 comprises a flexibly-deformable end portion obtained at the end of the cup-shaped body turned towards the valve body, which end portion is provided with a protuberance 180, for example annular and concentric to the central conduit 10, which projects towards an internal volume of the cup-shaped portion. The snap coupling mechanism of the second retaining body 145 also comprises a cavity, for example an annular groove 185 concentric with the central conduit 10, obtained in the valve body 5, that is in the second portion 35, and adapted to accommodate the protuberance 180 of the second retaining body and shaped so as to form a connection by obstacle with said protuberance.

The second retaining body 145 may comprise an abutment surface 190 for the second shutter 110, which abutment surface 190 is distanced from the valve body 5, is preferably perpendicular to the central axis Z, and defines an end stop when the second shutter 110 moves away from the valve body.

The abutment surface 190 contacts a surface of the second shutter turned in the opposite direction with respect to the contact surface with the seat of the second shutter itself.

The second retaining body 145 may comprise a through hole 195 made at a bot-tom wall of the cup-shaped portion opposite to the portion of the second retaining body in contact with the valve body 5. This through hole 195 is directly and always in fluid communication with the through hole 125 of the second shutter, in particular it is also coaxial with the central axis Z. In particular, this through hole 195 is crossed by at least part of the flow of fluid which crosses the second opening 20 of the central conduit 10.

The second retaining body 145 can also comprise at least a through opening 200 made in the cup-shaped portion and configured so that, when the second shutter is in contact with the abutment surface 190, i.e. is in the position of maximum opening, the second shutter 110 only partially occludes the through opening.

From a fluid-dynamic point of view, the through opening 200 is parallel to the through hole 195 with respect to the second opening 20 of the central conduit 10.

The through opening 200 is eccentric with respect to the through hole 195 and for example also radially more external than the abutment surface 190 of the second shutter (with respect to the central axis Z). In particular, the second shut-ter 110 projects radially with respect to the abutment surface 190 of the second retaining body (in the direction of away-movement from the central axis Z) and the through opening 200 is at least partially aligned with this portion which projects along a direction parallel to the central axis Z.

Thanks to the through opening 200, it is possible to bring the second shutter 110 into the closing position more quickly when the pressure at the second opening 90 of the peripheral conduit is lower than the pressure measured at an external point with respect to the cup-shaped portion of the second retaining body 145.

Preferably, the second retaining body 145 comprises a plurality of through openings 200 arranged circumferentially around the through hole 195.

In the embodiments illustrated, the first retaining body and the second retaining body are cup-shaped, i.e. the cup-shaped portion discussed above substantially constitutes the retaining body itself. However, it is not excluded that in an embodiment which is not illustrated, the retaining body may be shaped as a folded rod or sheet.

Figure 4:
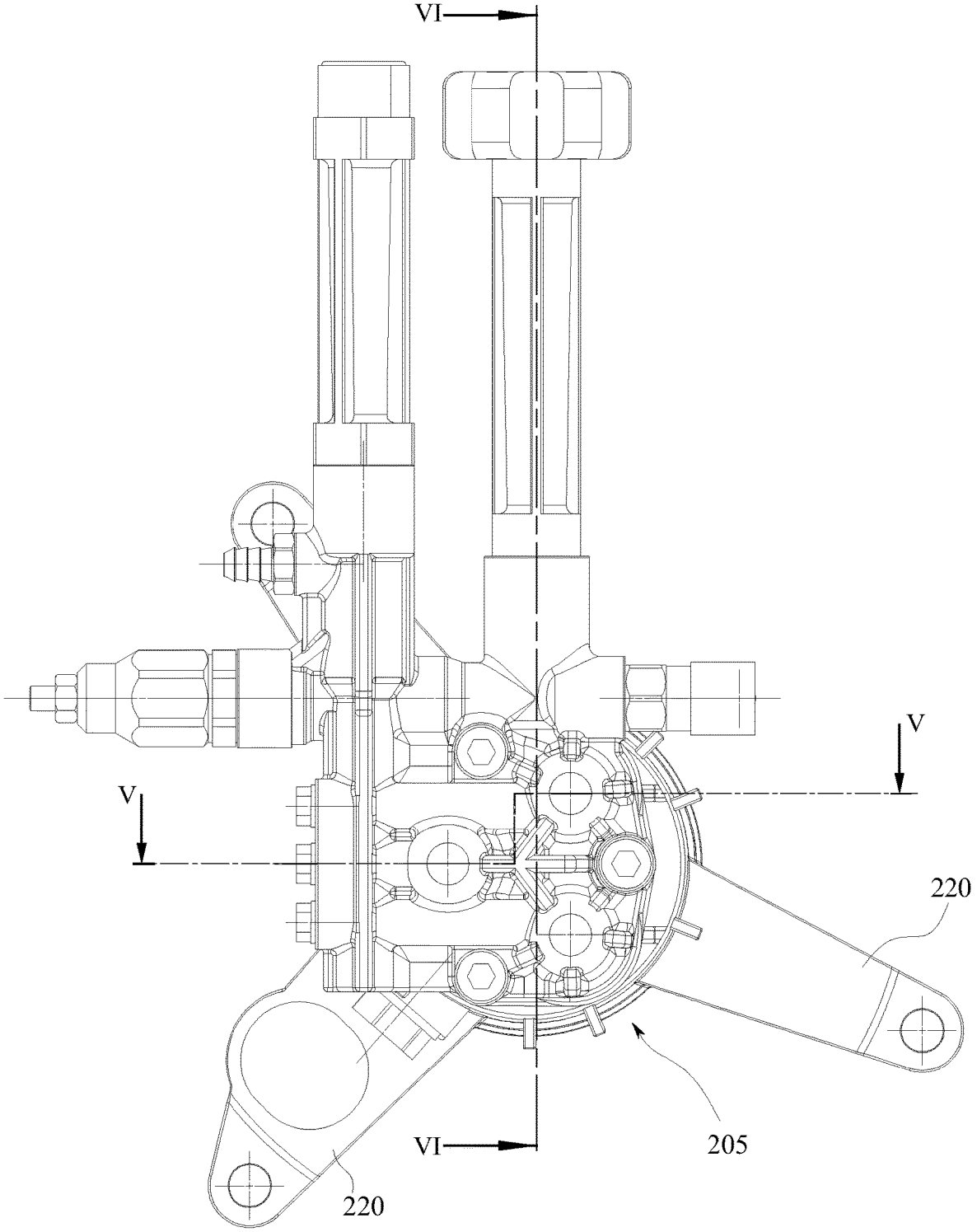
FIG. 4 is a top view of a pump provided with the valve according to the invention.
Figure 5:
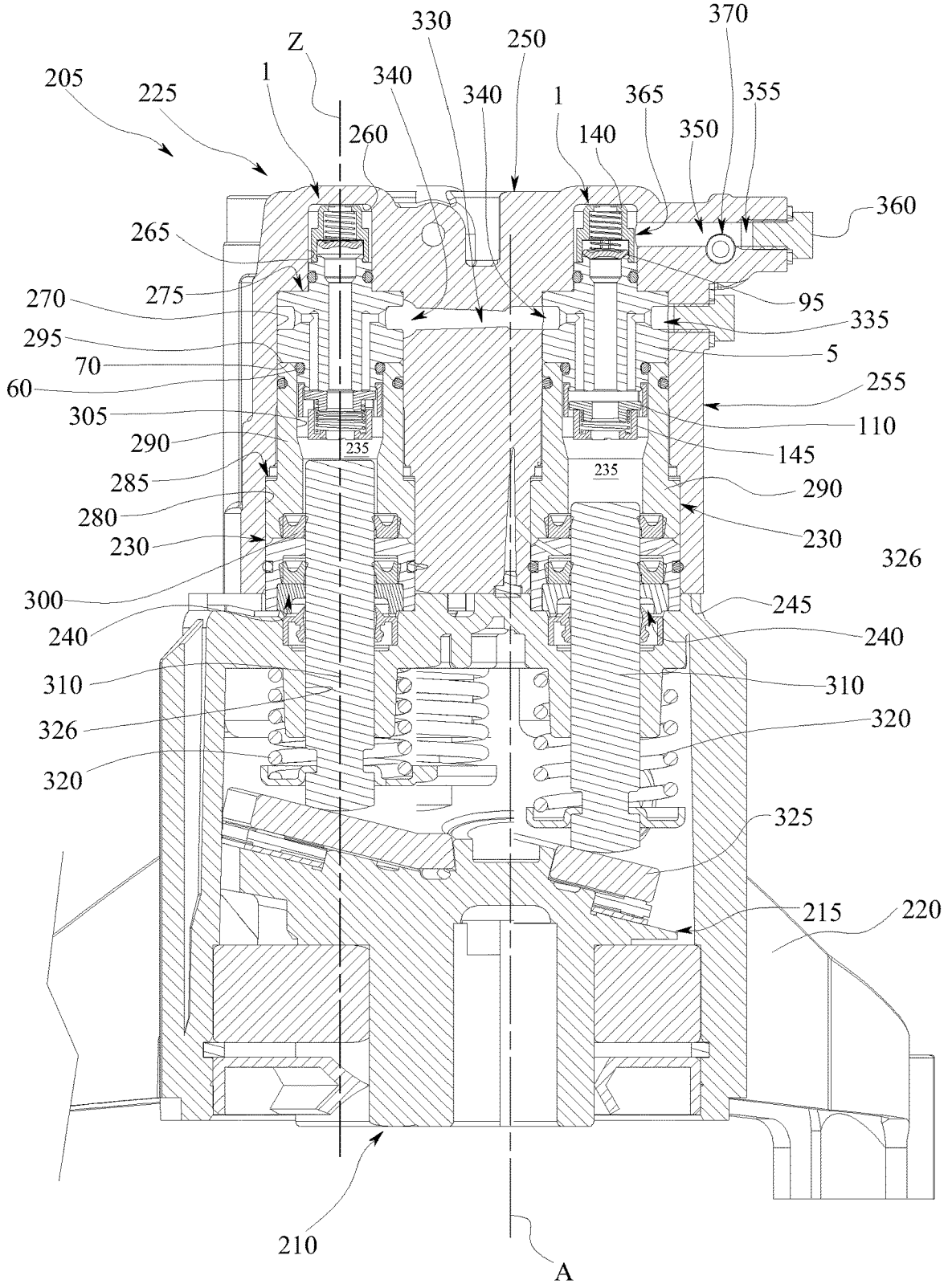
FIG. 5 is a sectional view of the pump of FIG. 4 according to the plane V-V.
Figure 6:
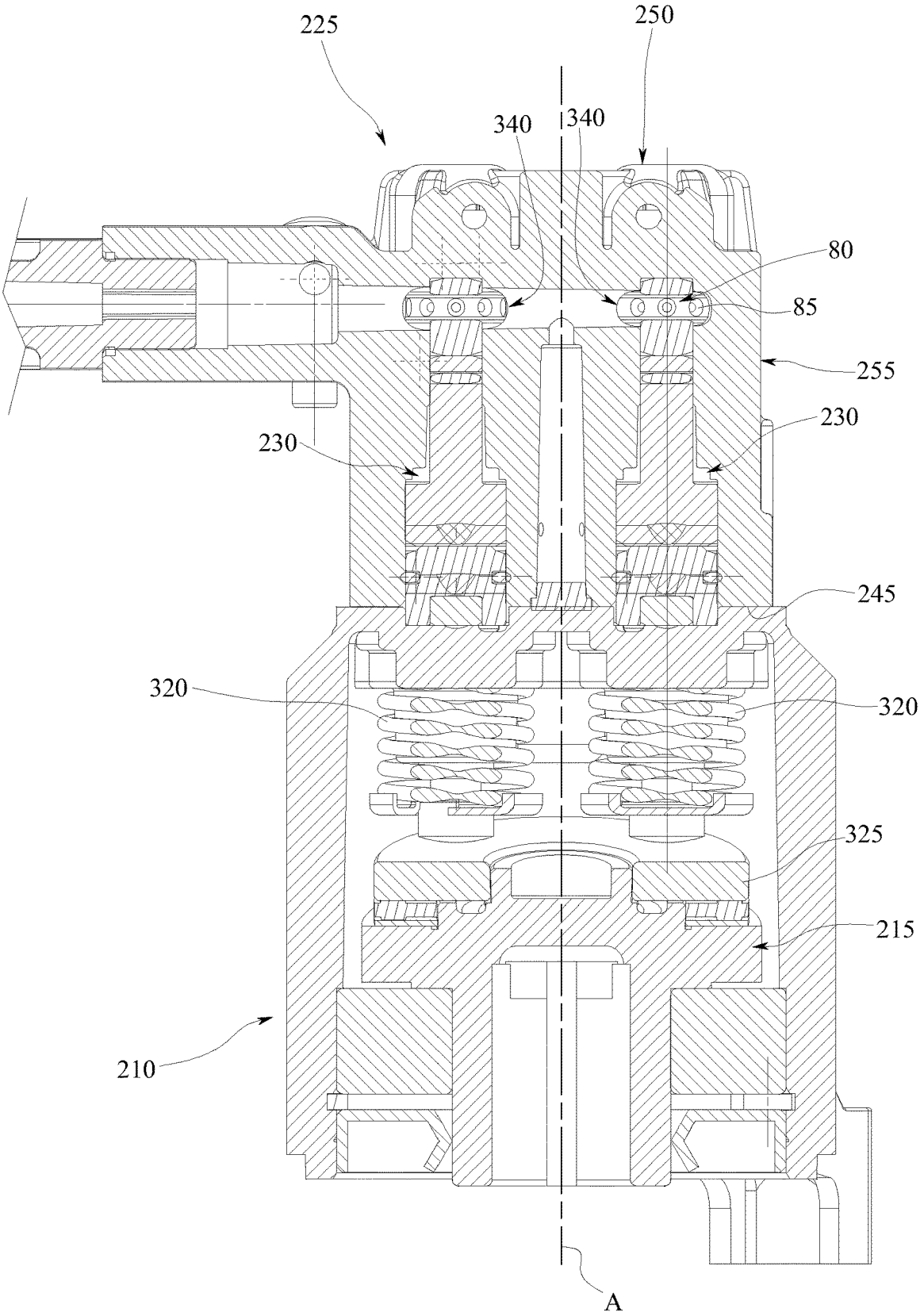
FIG. 6 is a sectional view of the pump of FIG. 4 according to the plane VI-VI.

With particular reference to FIGS. 4 and 5, the number 205 indicates an axial piston pump for high pressures, provided with at least a valve 1 for adjusting the pumping flow. In particular, it is an axial piston pump for high pressures and of the type with inclined rotating piston with fixed inclination.

The axial piston pump 205 can comprise a base 210, a rotating plate 215, adapted to receive a rotary motion from a motor shaft external to the axial piston pump 205, and for example a flange 220 for fixing to a motor provided with said motor shaft.

The rotating plate 215 is housed in the base 210, is rotatably associated there—with with respect to an axis of rotation A, and for example it comprises a flat annular surface lying on a plane inclined with respect to the axis of rotation A.

The axial piston pump 205 comprises a head 225 fixed to the base 210, that is fixed without residual degrees of freedom to the base 210, in which a plurality of cylinders 230, i.e. cylindrical holes, is made, each adapted to contain respective pumping chambers 235 of the liquid and arranged with respective central axes parallel to each other.

Such central axes are also preferably parallel to the axis of rotation A.

The head 225 can be made as a monolithic body, that can be obtained by machining a single body obtained by solidifying a single cast or injection of material into a mold.

For example, the cylinders 230 are arranged radially along a common axis, with respect to which the central axes are parallel. Furthermore, they are placed at an equal distance from each other and at the same distance with respect to the common axis. In other words, the cylinders 230, that is the central axes of the cylinders 230, are arranged angularly at an equal distance to each other along an imaginary circumference centered on the common axis. For example, the common axis of cylinders 230 is the axis of rotation A.

Preferably the cylinders 230 are made as blind holes each having an opening 240 turned towards the base. In particular, the head can comprise a first face 245, which is transversal to the central axes of the cylinders, is proximal, prefer-ably in contact, to the base 210, and is for example flat, and an opposite second face 250, which is transversal to the central axes of the cylinders and distal to the base 210. The cylinders 230, i.e. the cylindrical holes, cross only the first face 245, making the respective opening 240 therein. In practice, the second face 250 turns out to be continuous, that is, without interruption. That is, with respect to the axial piston pumps of the prior art, it does not have holes which cross the second face 250.

It is specified that the second face 250 and the first face 245 are connected by a tubular shaped lateral surface 255 of the head.

Each cylinder comprises a bottom portion opposite to the respective opening 240 and which comprises a bottom wall 260 lying on a plane transversal, for example perpendicular, to the axis of the cylinder itself. For example, the bottom wall 260 is separated from the second face of the head by a non-null distance.

The valve 1 is housed at this bottom portion, which is shaped so that the valve 1 is arranged with the second opening 20 of the central conduit 10 turned towards the opening of the cylinders.

The valve 1 is totally contained in the bottom portion.

In detail, this bottom portion comprises a first cylindrical surface 265, for example coaxial to the axis of the cylinder 230, which develops starting from the bottom surface 260 in the direction of the opening 240 of the cylinder 230, in which a portion of the valve body, in particular the first portion 30, is inserted to size. In practice, the first cylindrical surface 265 has a larger diameter than the diameter of the cylindrical lateral surface 30*a* of the first portion 30 of the valve body 5.

The first retaining body 140 is completely contained in a volume which is partial-ly defined by the first cylindrical surface 265 and the bottom wall 260.

The first cylindrical surface 265 has an extension in the direction of the axis of the cylinder 230 at least equal to the distance, measured in the same direction, between the first abutment surface 65 of the valve body 5 and a surface of the first retaining body 140 at the maximum distance from the first abutment surface 65.

The diameter of the first cylindrical surface 265 is always greater over its entire extension, in the direction of the central axis of the cylinder, with respect to the maximum overall dimension of the first retaining body 140 in a direction perpendicular to the central axis of the cylinder. That is, the first cylindrical surface 265 is shaped so that between itself and the first retaining body 140 there is an annular gap of non-null dimension along the entire extension of the first cylindrical surface itself.

In other words, the bottom portion does not comprise any surface that contacts the first retaining body 140 in such a way as to maintain it in contact with the valve body 5, i.e. the bottom portion does not comprise any shoulder in order to maintain in position the first retaining body 140.

The sealing gasket 50 housed in the seat 45 obtained in the first portion 30 is then pressed between its seat and the first cylindrical surface 265.

The bottom portion also comprises a second cylindrical surface 270 which develops in the direction of the opening 240 and which is directly connected to the first cylindrical surface 265 by means of a step 275 on which the first abutment surface of the valve 1 rests. The second cylindrical surface 270 has a diameter such as to accommodate the third portion 40 to size, i.e. it has a diameter substantially equal to the diameter of the cylindrical lateral surface 40*a* of the third portion 40 of the valve body.

The cylinder comprises an inlet portion which develops from the bottom portion to the opening 240 and comprises a third cylindrical surface 280, which develops in the direction of the opening 240 and is directly connected to the second cylindrical surface 270 by means of a further step 285. The third cylindrical sur-face 280 has a larger diameter than the second cylindrical surface 270.

The axial piston pump 205 then comprises a cylindrical tubular-shaped jacket 290 inserted inside each cylinder 230 and provided at one of its axial ends with an annular abutment surface 295, lying on a plane transversal to the central axis Z, for example perpendicular to the central axis Z, which contacts the second abutment surface 70 of the valve 1.

The base and the jacket are shaped in such a way that when the head 225 is fixed to the base 210, the jacket 290 pushes on the second abutment surface 70 of the valve body 5, maintaining the first abutment surface 65 of the valve body in contact with the step 275 substantially by maintaining the valve 1 in the seat.

For example, between an axial end of the jacket 290 opposite to the one that contacts the valve 1 and the base there is at least a sleeve adapted to house a sealing gasket 300 and which is compressed between the jacket and the base itself when the head is fixed to the base.

The jacket comprises an internal surface 305, which, at the annular abutment surface 295, has a diameter such as to accommodate the second portion 35 of the valve body to size, i.e. with reduced clearance. That is, the minimum diameter of the internal surface of the jacket at the annular abutment surface 295 is greater than the diameter of the cylindrical lateral surface 35*a* of the second portion 35 of the valve body 5.

The sealing gasket 60 housed in the seat 55 obtained in the second portion 35 is then pressed between its seat and said internal surface 305.

Between the internal surface 305 of the jacket and the second retaining body 145 there is always a gap of non-null dimension.

Furthermore, a profile of the internal surface 305 defined by a section plane containing the central axis of the cylinder forms, in each of its segments, an acute angle of less than 30° with an axis parallel to the central axis Z and which inter-sects the profile itself.

In other words, the jacket does not comprise any surface that contacts the second retaining body 145 in such a way as to maintain it in contact with the valve body 5 or such as to maintain a spacer in contact with the second retaining body so that it compresses it against the valve body 5, i.e. the jacket does not comprise any shoulder for maintaining in position the second retaining body.

In the illustrated embodiment, the internal surface 305 of the jacket comprises a first cylindrical segment which accommodates the second portion of the valve body to size, a second truncated-conical segment directly contiguous to the first segment and a profile of which defined by a section plane containing the central axis of the cylinder forms an acute angle of less than 20° with an axis parallel to the central axis and which intersects the profile itself, and a third cylindrical segment directly contiguous to the second segment and having a smaller diameter than the first segment.

Said jacket can be made of aluminum or steel or brass, preferably aluminum.

The axial piston pump 205 comprises a plurality of pistons 310 each adapted to slide in a respective cylinder 230, i.e. in a respective cylinder jacket 290, activated by the rotating plate 215 to pump the fluid present in the respective pumping chamber 235 which is at least partially defined by the cylinder, i.e. by the cylinder jacket, and by the valve 1.

In particular, the volume of the pumping chamber 235 is at least partially defined by the piston 310, by the cylinder, i.e. by the cylinder jacket, by the valve body, by the central conduit 10 and by the first shutter 95.

Following the rotation of the rotating plate 215, the pistons 310 are made to slide along the central axes of the respective cylinders 230 between a position of top dead center, in which the volume of the pumping chamber 235 is minimum, and a position of bottom dead center, in which the volume of the pumping chamber is maximum.

In the illustrated embodiment, each piston 310 has a first axial end which partially delimits the pumping chamber and an opposite second axial end which protrudes from the cylinder inside the base 210 and, by means of a respective elastic element 320, is maintained in contact with an annular guide 325 which rests on a flat annular surface of the rotating plate 215.

Each elastic element 320 has a first end connected to the base 210 and a second end connected to the piston 310, for example near the second end.

The axial piston pump 205 comprises a plurality of annular seals adapted to sealingly encircle a respective piston 310, for example some of said annular gaskets being housed in the base 210 and others in the head 20, in particular in the cylinder jacket, to prevent a fluid communication between the pumping chambers 235 and the base 210.

Furthermore, the axial piston pump 205 can comprise a plurality of guide bushings 326, for example made in the base 210, each adapted to guide a respective piston 310 in sliding along the central axis of the corresponding cylinder 230.

These guide bushings 326 are in communication with the respective openings 240 of the cylinders made in the head 225.

The axial piston pump 205 can comprise a plurality of tightening screws, configured to fix the head to the base and which are inserted in as many through holes made in the head.

The pump comprises at least a suction conduit 330 for the cylinders, which comprises a hole which is obtained in the head 225 and is provided with an opening 335 made in the lateral surface 255 of the head.

This suction conduit then comprises at least an outlet opening 340, one for each cylinder, which are obtained in the bottom portion of the cylinder, in particular at the second cylindrical surface 270.

This hole of the suction conduit has a longitudinal axis inclined by an angle of less than 2° with respect to a plane perpendicular to the central axis of the cylinder. In the illustrated embodiment, the longitudinal axis of the suction conduit, i.e. of the respective hole made in the head, is perpendicular to the axis of the cylinder.

The pump comprises a suction manifold to the suction conduit 330.

The pump 1 comprises a plurality of delivery conduits 350, each of which comprises a hole which is obtained in the head 225 and is provided with an outlet opening 355 made in the lateral surface 255 of the head. Each delivery conduit 350 comprises a plug 360 which hermetically closes the respective outlet opening.

Each delivery conduit 350 comprises an inlet opening 365 for each cylinder 230, which inlet opening is made in the bottom portion of the cylinder, in particular at the first cylindrical surface 265.

Each hole of a respective delivery conduit has a longitudinal axis inclined by an angle of less than 2° with respect to a plane perpendicular to the central axis of the cylinder. In the illustrated embodiment, the longitudinal axis of the hole in the delivery conduit is perpendicular to the axis of the cylinder.

The pump also comprises a delivery manifold 370 adapted to join all the delivery conduits 350, which is made in the head and comprises a hole that is obtained in the head 225 and is provided with an outlet opening made in the lateral sur-face of the head.

This hole in the delivery manifold has a longitudinal axis inclined by an angle of less than 2° with respect to a plane perpendicular to the central axis of the cylinder. In the illustrated embodiment, the longitudinal axis of the hole of the delivery manifold is perpendicular to the axis of the cylinder.

The head is preferably made of aluminum.

In particular, the head can be made of aluminum since the cylinder jacket and the valve are shaped and positioned in such a way as to isolate the pumping chamber from the cylinder and therefore isolate the head from pressure pulsations that create problems from the point of view of the fatigue wear.

The operation of the valve and of the pump provided with this valve is as follows.

When the pump performs a suction phase, i.e. when the piston descends towards the lower dead center, a depression is created in the pumping chamber such that the first elastic element 130 maintains the first shutter in the closing position, isolating the pumping chamber 235 from the delivery conduit and the fluid present in the suction conduit overcomes the force of the second elastic element 135 bringing the second shutter 110 into the open position. In this way the fluid from the delivery pipe flows into the pumping chamber.

When the piston rises from the bottom dead center towards the top dead center, the pump performs a pumping phase, during which the increase in pressure in the pumping chamber allows the second elastic element 135 to bring the second shutter into the closing phase and the pressurized fluid through the central channel pushes on the first shutter 95 overcoming the force of the first elastic element 130 in such a way as to bring the first shutter into the opening position and send the fluid to the delivery conduit.

Figure 7:
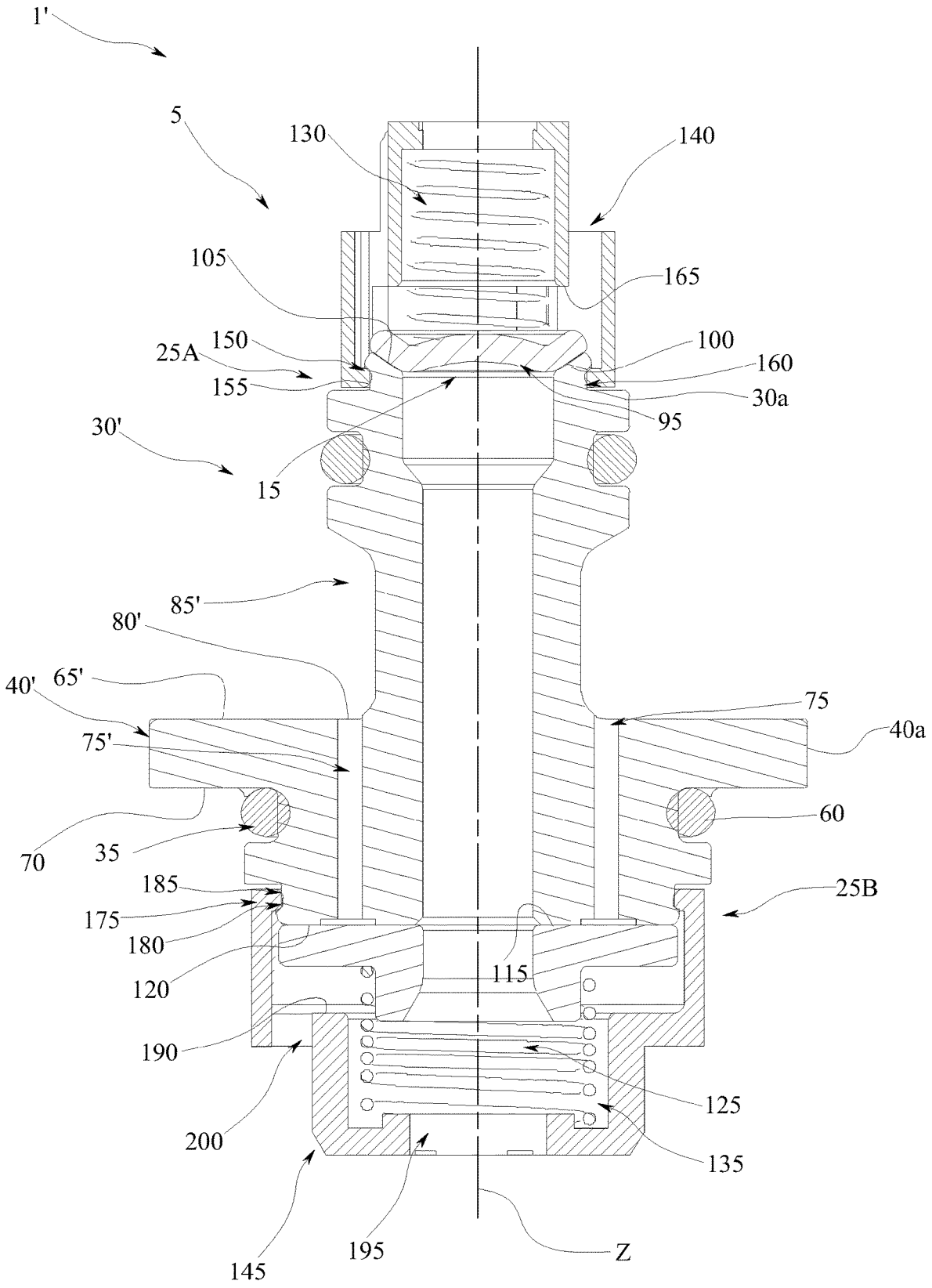
FIG. 7 is a sectional view of an alternative embodiment of the valve according to the invention.
Figure 8:
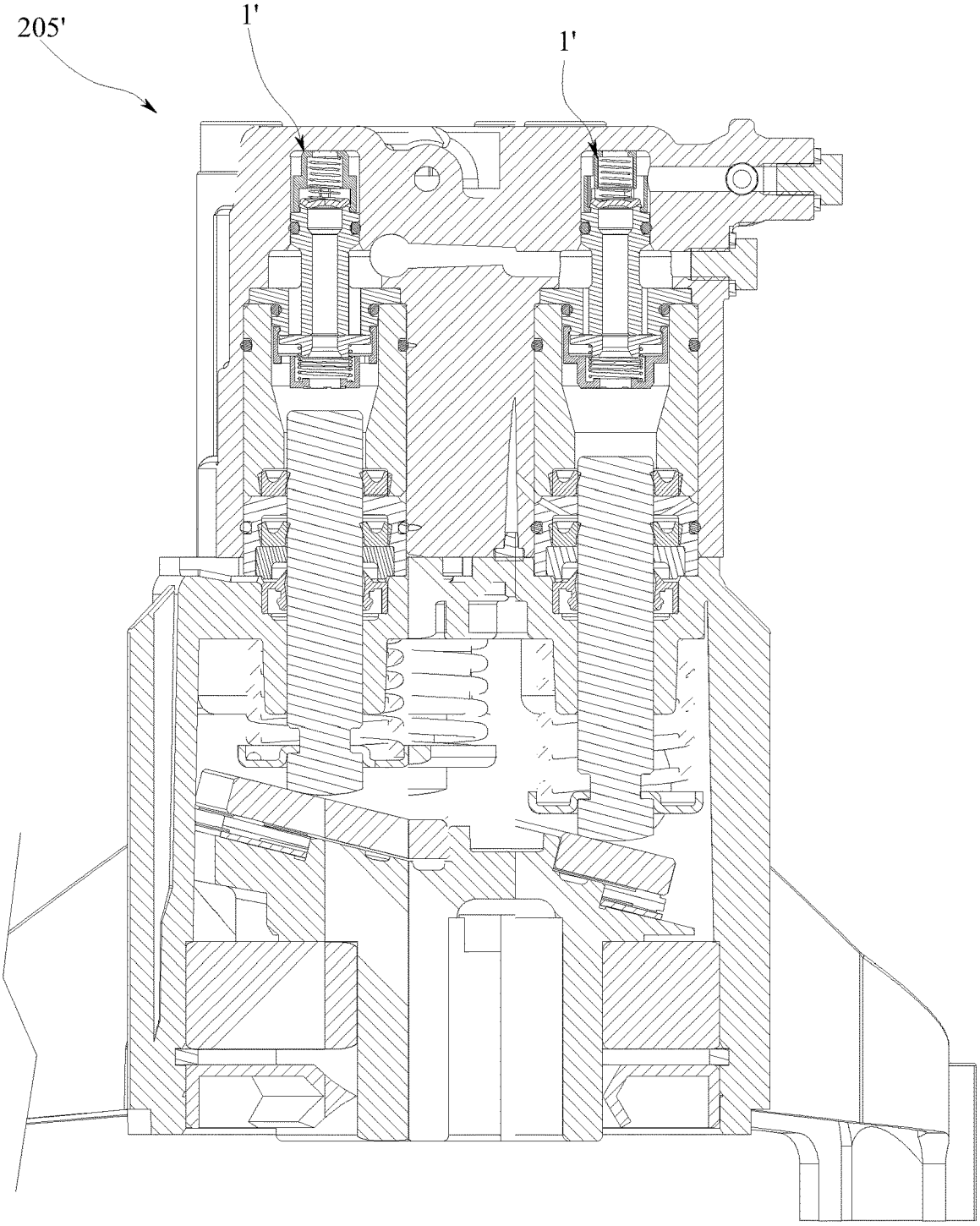
FIG. 8 is a sectional view of an axial piston pump according to the invention provided with the embodiment of the valve illustrated in FIG. 7.

With particular reference to FIGS. 7 and 8, an alternative embodiment of a valve 1' and an axial piston pump 205' provided with a rotating piston in which said valve 1' is installed is respectively shown.

The valve 1' substantially differs from the valve 1 in that the first opening 80' of the peripheral channel 75' is made in the first abutment surface 65', which in this case is turned towards the first opening 15 of the central channel 10, and that the annular groove 85' is made in the first portion 30' instead of in the third portion 45'.

For example, in this embodiment the peripheral channel 75' comprises only a rectilinear hole parallel to the axis Z.

Furthermore, the annular groove 85' is directly adjacent to the first abutment sur-face 65'.

The invention thus conceived is susceptible to several modifications and variations, all falling within the scope of the inventive concept.

Moreover, all the details can be replaced by other technically equivalent elements.

In practice, the materials used, as well as the contingent shapes and sizes, can be whatever according to the requirements without for this reason departing from the scope of protection of the following claims.

The invention claimed is:

1. An automatic bidirectional valve (1,1') for high pressure pumps comprising:

a valve body (5)

a central conduit (10) of the through type that crosses the valve body (5) and is provided with a first opening (15) made in a first end (25A) of the valve body (5) and a second opening (20) made in an opposite second end (25B) of the valve body (5), a peripheral conduit (75,75') made in the valve body (5), eccentric with respect to the central conduit (10) and provided with a first opening (80,80'), made in a portion of the valve body (5) comprised between the first end (25A) and the second end (25B), and a second opening (90) made in the second end (25B) of the valve body (5), a first shutter (95) movable at least between a closing position, in which it hermetically obstructs the first opening (15) of the central conduit (10), and an opening position, in which it is distanced from the first opening (15) of the central conduit (10) and allows the passage of flow through the first opening itself, a first elastic element (130) configured to generate a force adapted to maintain the first shutter (95) in the closing position, a second shutter (110) movable at least between a closing position, in which it hermetically obstructs the second opening (90) of the peripheral conduit (75), and an opening position, in which it is distanced from the second opening (90) of the peripheral conduit (75) and allows the passage of flow through the second opening itself, a second elastic element (135) configured to generate a force adapted to maintain the second shutter (110) in the closing position, and a retaining body (140,145) removably fixed to the valve body (5) and configured to hold in position one from among the first elastic element (130) and the second elastic element (135) so that said elastic element exercises said force on the respective shutter (95,110), wherein the retaining body (140,145) is fixed to the valve body by means of a snap coupling mechanism (150,175) in which at least one of the valve body or the retaining body (140,145) deforms elastically against the other during a mutual approach of said bodies, so that during said approach a protuberance of one body slides on a contact surface of the other body until it is inserted into a cavity of said other body, where it is then maintained owing to the elastic deformation generated during the relative sliding, the cavity being shaped such as to prevent, by obstacle, a movement of the retaining body (140,145) along a direction parallel to the central axis Z.

2. The automatic bidirectional valve (1,1') according to claim 1, comprising a first retaining body (140) adapted to retain the first elastic element (130) and a second retaining body fixed to the valve body and adapted to retain the second elastic element (135), wherein the second retaining body (145) comprises:

an abutment surface (190) for the second shutter, which abutment surface is distanced from the valve body and defines an end stop when the second shutter moves away from the valve body, and a cup-shaped portion provided with a through hole (195) at least partially aligned with the central conduit (10) of the valve body and a through opening (200) eccentric with respect to the through hole (195) and adapted to be at least partially closed by the second shutter (145) when a flow at the outlet from the peripheral conduit (75) over-comes the force of the second elastic element (135), wherein the through opening is eccentric with respect to the through hole and also radially more external than the abutment surface of the second shutter with respect to the central axis.

3. The automatic bidirectional valve (1,1') according to claim 1, wherein the valve body (5) is monolithic, made of a single material.

4. The automatic bidirectional valve (1,1') according to claim 3, wherein the single material is a metal material chosen from the group consisting of: stainless steel, brass alloys and aluminum alloys.

5. The automatic bidirectional valve (1,1') according to claim 1, wherein the retaining body (140,145) elastically deforms with respect to the valve body.

6. The automatic bidirectional valve (1,1') according to claim 5, wherein the retaining body can comprise at least an end portion provided with a protuberance and a flexibly-deformable wall, from which the protuberance projects towards the center of the retaining body itself, and the valve body comprises a cavity in the form of an annular groove, adapted to accommodate the retaining body and shaped such as to prevent, by obstacle, a movement of the retaining body along a direction parallel to the central axis.

7. An axial piston pump (205,205') for pumping a liquid comprising:

a base (210), a head (225) fixed to said base (210);

a plurality of cylinders (230) having central axes parallel to each other and obtained in the head (225), a plurality of pistons (310) that each slide within a respective cylinder of the plurality of cylinders for the pumping of the liquid, a rotating plate (215) configured to activate the sliding of said pistons (310) within the respective cylinders (230), and an automatic bidirectional valve (1,1'), for each cylinder (230), the automatic bidirectional valve (1,1') comprising:

a valve body (5)

a central conduit (10) of the through type that crosses the valve body (5) and is provided with a first opening (15) made in a first end (25A) of the valve body (5) and a second opening (20) made in an opposite second end (25B) of the valve body (5), a peripheral conduit (75,75') made in the valve body (5), eccentric with respect to the central conduit (10) and provided with a first opening (80,80'), made in a portion of the valve body (5) comprised between the first end (25A) and the second end (25B), and a second opening (90) made in the second end (25B) of the valve body (5), a first shutter (95) movable at least between a closing position, in which it hermetically obstructs the first opening (15) of the central conduit (10), and an opening position, in which it is distanced from the first opening (15) of the central conduit (10) and allows the passage of flow through the first opening itself, a first elastic element (130) configured to generate a force adapted to maintain the first shutter (95) in the closing position, a second shutter (110) movable at least between a closing position, in which it hermetically obstructs the second opening (90) of the peripheral conduit (75), and an opening position, in which it is distanced from the second opening (90) of the peripheral conduit (75) and allows the passage of flow through the second opening itself, a second elastic element (135) configured to generate a force adapted to maintain the second shutter (110) in the closing position, and a retaining body (140,145) fixed to the valve body (5) and configured to hold in position one from among the first elastic element (130) and the second elastic element (135) so that said elastic element exercises said force on the respective shutter (95,110).

8. The pump (205,205') according to claim 7, wherein each cylinder (230) is made in the head as a blind hole, and wherein each automatic bidirectional valve (1,1') is housed in a bottom portion of the respective cylinder (230), which bottom portion is shaped so that the automatic bidirectional valve (1,1') is oriented with the central axis of the central conduit (10) parallel to a central axis of the cylinder and closes said bottom portion.

9. The pump (205,205') according to claim 8, wherein each cylinder (230) comprises a jacket (290) inserted into the cylinder and within which the respective piston slides (310), which jacket extends from the automatic bidirectional valve (1,1') to at least a first annular sealing gasket which encircles the piston (310).

10. The automatic bidirectional valve (1,1') according to claim 7, wherein the retaining body (140,145) elastically deforms with respect to the valve body.

11. The automatic bidirectional valve (1,1') according to claim 10, wherein the retaining body can comprise at least an end portion provided with a protuberance and a flexibly-deformable wall, from which the protuberance projects towards the center of the retaining body itself, and the valve body comprises a cavity in the form of an annular groove, adapted to accommodate the retaining body and shaped such as to prevent, by obstacle, a movement of the retaining body along a direction parallel to the central axis.

* * * * *